United States Patent [19]

Ott et al.

[11] Patent Number: 4,761,318

[45] Date of Patent: Aug. 2, 1988

[54] LOOP FASTENER PORTION WITH THERMOPLASTIC RESIN ATTACHING AND ANCHORING LAYER

[75] Inventors: Ronald L. Ott, Lake Elmo; Susan K. Nestegard, Woodbury, both of Minn.

[73] Assignee: Minnesota Mining and Manufacturing Company, Saint Paul, Minn.

[21] Appl. No.: 902,227

[22] Filed: Aug. 29, 1986

Related U.S. Application Data

[63] Continuation-in-part of Ser. No. 723,458, Apr. 15, 1985, Pat. No. 4,609,581.

[51] Int. Cl.[4] ..... B32B 3/06

[52] U.S. Cl. ..... 428/85; 156/244.11; 428/95; 428/100

[58] Field of Search ..... 428/85, 95, 100; 156/244.11

[56] References Cited

U.S. PATENT DOCUMENTS

| | | | |
|---|---|---|---|
| 3,537,946 | 11/1970 | Truax et al. | 161/66 |
| 3,567,565 | 3/1971 | Jones et al. | 161/50 |
| 3,618,608 | 11/1971 | Brink | 428/100 |
| 3,694,867 | 11/1972 | Stumpf | 24/204 |
| 3,773,580 | 11/1973 | Provost | 156/66 |
| 3,849,840 | 11/1974 | Yamada et al. | 428/100 |
| 3,940,525 | 2/1976 | Ballard | 428/96 |
| 4,609,581 | 9/1986 | Ott | 428/100 |

*Primary Examiner*—Marion C. McCamish

*Attorney, Agent, or Firm*—Donald M. Sell; William L. Huebsch

[57] ABSTRACT

A loop fastener portion including a soft flexible sheet-like fibrous structure having a multiplicity of loops along a first surface adapted to be releasably engaged by a mating fastener portion, and a layer of thermoplastic resin adhered to a second major surface of the fibrous structure which anchors the loops in the fibrous structure and is softenable by the application of heat to adhere the fastener portion to a substrate such as the surface of a disposable diaper.

5 Claims, 2 Drawing Sheets

LOOP FASTENER PORTION WITH THERMOPLASTIC RESIN ATTACHING AND ANCHORING LAYER

CROSS REFERENCE TO RELATED APPLICATIONS

This application is a continuation-in-part of U.S. patent application No. 723,458, filed Apr. 15, 1985, and issued Sept. 2, 1986 as U.S. Pat. No. 4,609,581.

TECHNICAL FIELD

The present invention relates to fastener portions including loops adapted to be releasably engaged by mating fastener portions which may include hooks or headed stems.

BACKGROUND ART

Fastener portions including loops (called loop fastener portions herein) adapted to be releasably engaged by other fastener portions which may include hooks or headed stems are well known in the art. Typically, such a loop fastener portion comprises a soft flexible sheet-like fibrous structure having a multiplicity of loops along a first major surface, which fibrous structure may be formed by any of several methods such as weaving, knitting, warp knitting, weft insertion knitting, stitch-sewing or the known methods for making nonwoven structures. Such loop fastener portions may also include adhesive coatings (e.g., thickened or foamed latex) to help bond together their fibers at their contact points both to restrict the loops on the loop fastener portions from enlarging and to restrict the fastener portions from tearing when tension is applied to the loops by mating fastener portions with which the looped fastener portions are engaged, such as upon the disengagement of such fastener portions.

Some such loop fastener portions are intended to be sewn in place, particularly where they are used on articles (e.g., clothing) that will be washed or dry cleaned. Other such loop fastener portions include a layer of pressure sensitive adhesive on their surface opposite their loops, which is often the preferred method of attaching loop fastener portions to objects that do not require launderability or that cannot be sewn.

Both of these methods of attachment have certain disadvantages, however. Sewing typically is labor intensive and can decrease the area of the fastener portion that can be engaged by a mating fastener portion. Also to facilitate sewing the fibrous structure of the loop fastener portion should have sufficient internal strength and integrity so that it can be held in place with a reasonable number of stitches, and thus it is impractical to sew certain types of loop fastener portions that may have, for example, nonwoven fibrous structures. When pressure sensitive adhesives are used, the fibrous structures must be sufficiently nonporous to prevent the loops from sticking to the adhesives and thus becoming unavailable for engagement with mating fastener portions. Also, prior to use, pressure sensitive adhesives on such loop fastener portions must be protected as by a liner which must be removed before the loop fastener is attached to an object.

DISCLOSURE OF THE INVENTION

The present invention provides a loop fastener portion including a fibrous structure and a simple means by which it may be fastened to an object which allows the loop fastener portion to be easily attached, bonds together the filaments of the fibrous structure to anchor the loops, sufficiently anchors the filaments to the backing so that even fibrous structures with relatively low internal strength and integrity can be used and will still provide loops that will provide shear and peel strengths comparable with loops from tightly woven fibrous structures, and does not present the possibility that loops will become adhered to it even when the fibrous structure is relatively porous.

According to the present invention there is provided a fastener portion including a soft flexible sheet-like fibrous structure having a multiplicity of loops along a first surface adapted to be releasably engaged by a mating fastener portion; and a layer of thermoplastic resin adhered to a major surface of the fibrous structures opposite the loops, which thermoplastic resin anchors the loops in the fibrous structure.

The fibrous structures of the loop fastener portions may be formed by any known method such as weaving, knitting, warp knitting, weft insertion knitting, stitch-sewing or the known methods for making nonwoven structures.

The thermoplastic resin may be of any conventional type such as polyethylene, polypropylene, blends and copolymers thereof, ethylene acrylic acid copolymer, nylon copolymers, or ethylene vinyl acetate copolymers and can be applied in any one of several methods such as by extrusion or roll coating of molten thermoplastic material directly onto the fibrous structure or by adhering thermoplastic film to the fibrous structure by hot nip lamination (i.e., softening only one surface portion of the thermoplastic film, pressing that softened surface against the fibrous structure, and allowing it to cool). After application, the thermoplastic resin will bond together the filaments of the fibrous structure to anchor the loops and will anchor the filaments and add sufficient internal strength and integrity to the loop fastener portion so that even very porous nonwoven structures are usable to form the loops.

The thermoplastic resin can be simultaneously applied both to the fibrous structure and to a substrate and thus used to adhere the fibrous structure to a substrate, as may be useful in making the coated abrasive structures described and claimed in U.S. Pat. No. 4,609,581, which will issue from U.S. patent application No. 723,458 of which this application is a continuation-in-part. Alternatively the thermoplastic resin can first be allowed to solidify and adhere to the fibrous structure and can subsequently be softened along its surface opposite the fibrous structure by exposure to heat, as by contact with a heated surface or from an infrared source of radiation, so that it will adhere quickly and securely to a substrate with which it is brought in contact (i.e., the polymeric outer layer of a disposable diaper) and the thermoplastic resin can add sufficient strength so that the loop fastener portion can be handled and applied to such a substrate at high speeds by automated equipment even when the fibrous structure by itself would have insufficient internal strength to afford such handling.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 1:
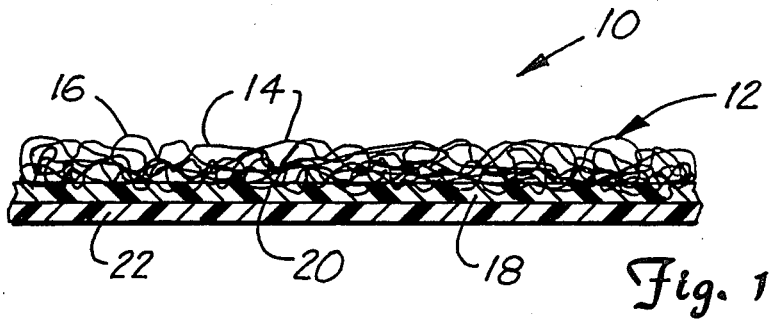
FIG. 1 is an edge view of a first embodiment of a loop fastener portion according to the present invention shown attached to a substrate.

Referring now to FIG. 1 there is shown a loop fastener portion according to the present invention generally designated by the reference numeral 10.

The fastener portion 10 includes a soft flexible sheet-like nonwoven fibrous structure 12 having a multiplicity of loops 14 along a first surface 16 adapted to be releasably engaged by a mating fastener portion (not shown); and a layer 18 of thermoplastic resin adhered to a second major surface 20 of the fibrous structure. Thermoplastic resin in the layer 18 anchors the loops 14 in the nonwoven fibrous structure 12 and is softenable by the application of heat to adhere the fastener portion 10 to a substrate such as the substrate 22 which may be a polymeric outer sheet of a diaper.

Figure 2:
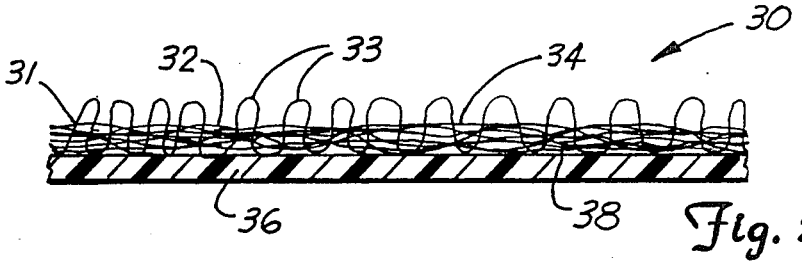
FIG. 2 is an edge view of a second embodiment of a loop fastener portion according to the present invention.

Referring now to FIG. 2 there is shown a second embodiment of a fastener portion according to the present invention generally designated by the reference numeral 30. The fastener portion 30 includes a soft flexible sheet-like fibrous stitch bonded structure 31 comprising a nonwoven backing 32 having a plurality of through stitches forming a multiplicity of loops 33 along a first surface 34 adapted to be releasably engaged by a mating fastener portion (not shown); and a layer 36 of thermoplastic resin adhered to a second major surface 38 of the fibrous structure 31. The layer 36 of thermoplastic resin anchors the stitches and thereby the loops 33 in the fibrous structure 31 and is softenable by the application of heat to afford adhering the fastener portion 30 to a substrate.

Figure 3:
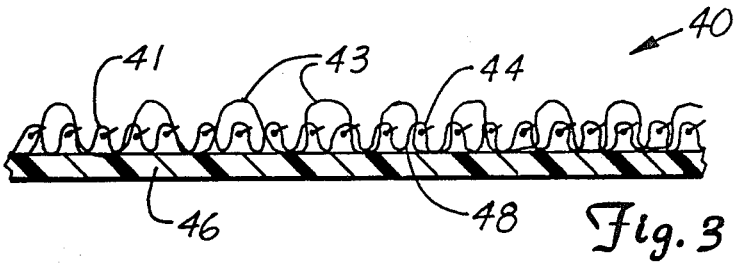
FIG. 3 is an edge view of a third embodiment of a loop fastener portion according to the present invention.

Referring now to FIG. 3 there is shown yet a third embodiment of a fastener portion according to the present invention generally designated by the reference numeral 40. The fastener portion 40 includes a soft flexible sheet-like knitted structure 41 comprising a multiplicity of loops 43 along a first surface 44 adapted to be releasably engaged by a mating fastener portion (not shown); and a layer 46 of thermoplastic resin adhered to a second major surface 48 of the fibrous structure. The thermoplastic resin anchors the knitted fibers and thereby the loops 43 in the fibrous structure 41 and is softenable by the application of heat to afford adhering the fastener portion 40 to a substrate.

Figure 4:
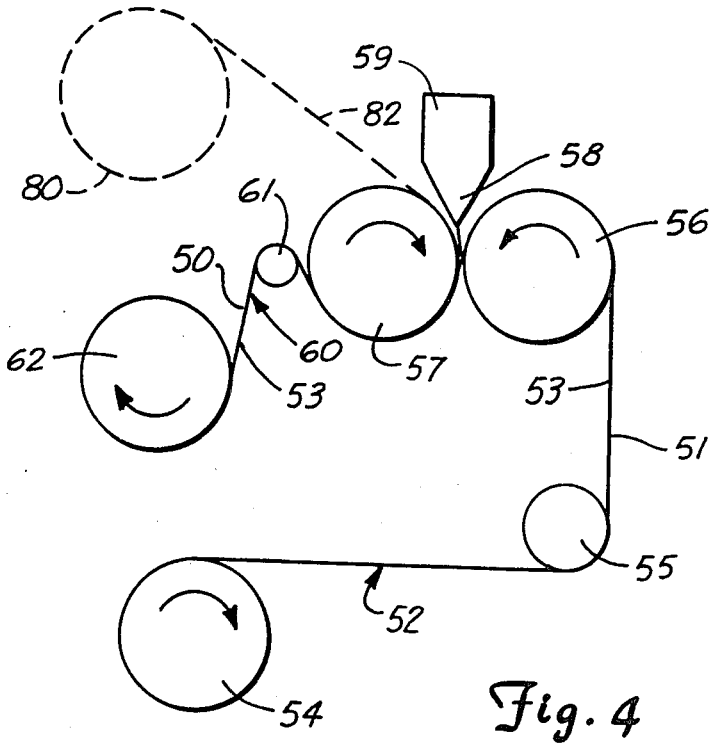
FIG. 4 schematically illustrates a method for forming loop fastener portions according to the present invention.

Referring now to FIG. 4 there is schematically illustrated one method for applying a layer 50 of thermoplastic resin to a second surface 51 of a fibrous structure 52 having a plurality of loops along a first surface 53 to provide a laminate 60 that could be cut into pieces to provide fastener portions like those described above. As illustrated, the fibrous structure 52 is pulled from a supply roll 54 around a guide roller 55 around a first chrome plated application roll 56 and through a nip between the first application roll 56 and a second rubber covered application roll 57. A drop die 58 from an extruder 59 deposits molten thermoplastic material along the nip between the second surface 51 of the fibrous structure 52 and the second application roll 57. The layer 50 of thermoplastic material is adhered to the fibrous structure 52 at the nip between the application rollers 56 and 57, and the layer 50 passes with the fibrous structure 52 around a portion of the periphery of the second application roll 57, around a second guide roll 61 and onto a wind up roll 62.

Figure 5:
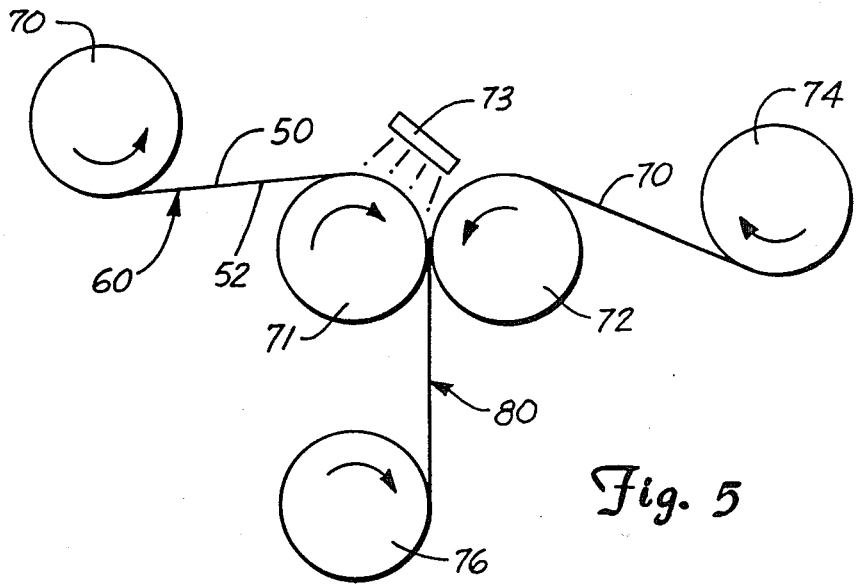
FIG. 5 schematically illustrates application of a loop fastener portion according to the present invention to a substrate.

FIG. 5 schematically illustrates the subsequent application to a substrate 70 of the laminate 60 of the fibrous structure 52 and the layer 50 of thermoplastic material. That laminate 60 is pulled from a supply roll 70 through the nip between spaced application rolls 71 and 72 around a portion of the periphery of the application roll 71 with the layer 50 of thermoplastic material facing outwardly where it will be heated and softened by an infrared heater 73 adjacent the application roll 71. The substrate 70 is pulled from a supply roll 74 and passes through the nip adjacent the softened layer 50 of thermoplastic material where it is pressed into contact with and is adhered to by that layer 50. The resulting composite 80 is then wound on a wind up roller 76.

It will be appreciated that the method illustrated in FIG. 5 can easily be modified by known means to cut and apply predetermined lengths of the laminate 60 of the fibrous structure 52 and the layer 60 of thermoplastic material to provide loop fastener portions, and can include subsequent steps of separating the substrate into predetermined lengths of a desired shape after those lengths are applied as may, for example, be done in applying such lengths to disposable diapers.

The following are examples of laminates 60 suitable for loop fastener portions that have been made using the methods illustrated in FIGS. 4 and 5.

EXAMPLE 1

A fibrous structure 52 in the form of a warp knitted fabric containing 40 denier polyester fill fibers and 40 denier polyester loop fibers (each with 20 ends per fiber) having 52 courses per inch and 16 wales per inch and a basis weight of 1.5 ounce/yard$^2$ was extrusion coated with an ethylene vinyl acetate copolymer thermoplastic resin containing 18 percent vinyl acetate and having a melt flow index of 8.0 using the method illustrated in FIG. 4. The extruder 59 provided a thermoplastic resin melt temperature of 420 degrees Fahrenheit. The application rolls 56 and 57 were internally chilled. A minimum nip pressure of 40 pounds per square inch was maintained on the rubber covered application roll 57. The linear speed of the fibrous structure 52 and the extruder revolutions per minute were adjusted to provide layers 50 of thermoplastic resin from 0.001 inch to 0.002 inch in thickness (i.e., 22 revolutions per minute extruder speed and linear speeds of the fibrous structure of from 85 to 50 feet per minute).

The resultant laminates 60 of the fibrous structure 52 and the layers 50 of thermoplastic material showed significant reductions in porosity compared to the fibrous structure 52 alone, and were easier to handle than the fibrous structure 53 alone due to a significant reduction in the ability to stretch the laminates 60 compared to the fibrous structure 52 alone.

The resultant laminates 60 of the fibrous structure 52 and the layers 50 of thermoplastic material were then applied to a substrate 70 using the method illustrated in FIG. 2 by passing them over the rubber covered application roll 71 that was maintained at 200 degrees Fahrenheit. The substrate 70 consisted of a 0.001 inch thick sheet of low density polyethylene such as is often used as the outer layer of a disposable diaper. The chrome plated application roll 72 was maintained at a temperature (i.e., 200 degrees Fahrenheit) below the softening or deformation point of the film 70. The infrared heater 73 was located approximately 9 inches from the application roll 71 and produced 5000 watts of radiant energy.

A minimum of pressure was required to provide adequate contact between the film 70 and layer 50 of thermoplastic material in the nip between the application rolls 71 and 72, and the film 70 was found to be firmly adhered to the layer 50 of thermoplastic material after it had cooled.

EXAMPLE 2

A fibrous structure 52 in the form of a 0.9 ounce/yd$^2$ resin bonded nonwoven polyester with stitchbonded loops consisting of 150 denier texturized polyester with 40 ends stitched on Malimo TM Sewing-knitting equipment at 12 courses per inch and 13 wales per inch to produce an overall basis weight of 2.3 ounce/yd$^2$ was extrusion coated with the device illustrated in FIG. 4. The thermoplastic resin applied by the extruder 59 was a low density polyethylene with a melt index of 5.0. The extruder 59 conditions were such as to provide a melt temperature of 288 degrees Centigrade (550 degrees Fahrenheit). Layers 50 of thermoplastic resin 0.001 inch and 0.002 inch thick were obtained using an extruder screw speed of 22 revolutions per minute and speeds of the fibrous structure 52 past the extruder die 58 of 87 feet per minute and 71 feet per minute, respectively. The layers 50 of thermoplastic resin adhesively bonded the loops to the nonwoven fabric in the fibrous structure 52 and thus increased the amount of force required in either peel or shear modes to separate a mating fastener portion from the loops as compared to separating that same fastener portion from the loops of the fibrous structure 52 before the layer 50 of thermoplastic material was adhered to it. The resultant laminates 60 had greatly increased cross direction strength compared to the fibrous structure 52 alone and therefore were viewed as being more easily handled by high speed application equipment. The laminates 60 of the fibrous structure 52 and the adhered layers 50 of thermoplastic material were found to be easily attachable to certain substrates using the method described with reference to FIG. 5.

EXAMPLE 3

A fibrous structure 52 in the form of a carded nonwoven web was prepared as follows. Staple fibers (1¼ inch cut lengths of 4.75 denier crimped polyester) and binder fibers (1¼ inch cut lengths of 8 denier amorphous polyester) were blended at a ratio of 70% to 30% by weight, opened and fed to an even feeder that forms a fiber mat, and then processed in a roller top twin master card which constructed a nonwoven web having a basis weight of 3 ounces/yd$^2$. The web was then thermally set in a hot air oven to provide a lofty nonwoven fibrous structure 52 with low web integrity or internal strength.

The fibrous structure 52 was then extrusion coated by the method shown in FIG. 4 with an ethylene vinyl acetate copolymer resin. The resultant laminated structure 60 could be readily attached to a substrate using the method illustrated in FIG. 5.

EXAMPLE 4

A fibrous structure 52 was formed from a carrier web of a white Confil wetlaid nonwoven fabric comprising a blend of cellulose and polyester fibers bonded with a polymer believed to be an acrylate adhesive, purchased as Style 1309215 White Confil wetlaid fabric from International Paper Company. That carrier web was stitched on a 14 gauge Malimo TM type Malipol Sewing-knitting Machine operated in its single bar mode with 3 millimeter pile sinkers to produce 14 evenly spaced rows of stitches per inch in a cross web direction and to form 12 stitches per inch along each row and to form loops 14 projecting from the carrier web by about 1 to 2 millimeters. The thread 13 used to form the stitches was a commercial grade 150 denier, 34 filament flat polyester thread purchased from Milliken & Co. of Spartanburg, S.C.

This web was laminated to 88.5 pound Sanfast Abrasive Paper (purchased from James River Paper Co., Fitchburg, Massachusetts) using a slot die extruder in a device similar to that described above with reference to FIG. 4 except for the addition of a supply roll 80 of the paper 82 (shown in phantom outline in FIG. 4) which applied a 0.001 inch thick layer of low density polyethylene extruded at a die temperature of 600–625 degrees Fahrenheit. Excellent paper to fabric bonds were obtained at run speeds of 300 to 400 feet per minute.

The low density polyethylene not only bonded the fabric to the paper but also locked the stitches for repeated application and release to hook members.

The resultant laminated web could be used as a substrate for coated abrasives that may be used as described in U.S. Pat. No. 4,609,581 which will issue Sept. 2, 1986, the content whereof is incorporated herein by reference.

The present invention has now been described with reference to several embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

I claim:

1. A structure comprising:

a substrate; and a loop portion for a hook and loop fastener, said loop portion including:

a flexible sheet-like fibrous structure comprising a nonwoven layer having first and second major surfaces and a multiplicity of loops along said first surface adapted to be releasably engaged by the hook portion of the fastener, said nonwoven layer along having insufficient internal strength to adequately anchor the loops for use as the loop portion of a hook and loop fastener; and a layer of thermoplastic resin adhered to the second major surface of said fibrous structure, said thermoplastic resin bonding together said fibrous structure to add sufficient internal strength and integrity to the fastener portion and anchoring of said loops to afford use of said loop fastener portion as the loop portion of a hook and loop fastener, and adhering said loop fastener portion to said substrate.

2. A structure according to claim 1 wherein said substrate is the polymeric outer layer of a disposable diaper.

3. A method for forming a loop portion for a hook and loop fastener comprising:

providing a soft flexible sheet-like fibrous structure comprising a nonwoven layer having first and second major surfaces and a multiplicity of loops along its first surface adapted to be releasably engaged by the hook portion of the fastener, which nonwoven layer alone has insufficient internal strength to adequately anchor the loops for use as the loop portion of a hook and loop fastener;

extruding a layer of thermoplastic resin onto the second major surface of said fibrous structure sufficient to bond together the fibrous structure and to add sufficient internal strength and integrity to the fastener portion and anchoring of the loops to afford use of the loop fastener portion with the hook portion of a hook and loop fastener; and adhering the layer of thermoplastic resin to a substrate.

4. A method according to claim 3 further including the steps of:

allowing the layer of thermoplastic resin to cool after said extruding step and before said adhering step; and said adhering step includes softening the layer of thermoplastic resin by the application of heat and pressing the softened layer of thermoplastic resin against the substrate to adhere the fastener portion to the substrate.

5. A method according to claim 3 wherein said adhering step is performed simultaneously with said extruding step.

* * * * *